US007077147B2

(12) United States Patent
Louie et al.

(10) Patent No.: US 7,077,147 B2
(45) Date of Patent: Jul. 18, 2006

(54) COLLAPSIBLE AND FOLDABLE CANVAS STRUCTURE

(75) Inventors: Wai Hang Louie, Hunghom (HK); Genevieve Shiu, Mongkok (HK); Robert Hsu, Tsimshatsui (HK)

(73) Assignee: Genevieve Shiu, Mongkok (HK)

( * ) Notice: Subject to any disclaimer, the term of this patent is extended or adjusted under 35 U.S.C. 154(b) by 0 days.

(21) Appl. No.: 10/336,286

(22) Filed: Jan. 3, 2003

(65) Prior Publication Data

US 2004/0129307 A1 Jul. 8, 2004

(51) Int. Cl.
*E04H 15/48* (2006.01)

(52) U.S. Cl. ..... 135/143; 135/906

(58) Field of Classification Search ..... 135/143, 135/124, 125, 126, 127, 128, 130, 136, 137, 135/121, 117, 116, 97, 95, 906; 220/6, 9.2, 220/9.3, 9.4; 40/610

See application file for complete search history.

(56) References Cited

U.S. PATENT DOCUMENTS

| | | | | | |
|---|---|---|---|---|---|
| 2,036,033 | A | * | 3/1936 | Fisher | 135/133 |
| 2,167,219 | A | * | 7/1939 | Sankey | 135/133 |
| 2,266,853 | A | * | 12/1941 | Dabney | 135/126 |
| 2,531,501 | A | * | 11/1950 | Cline | 135/133 |
| 2,854,948 | A | * | 10/1958 | Drayson | 119/482 |
| 2,960,993 | A | * | 11/1960 | Holmstrom | 135/130 |
| 3,114,376 | A | * | 12/1963 | Rexroat | 135/121 |
| 3,800,814 | A | * | 4/1974 | Hibbert | 135/93 |
| 3,847,170 | A | | 11/1974 | Anderson | |
| 4,716,918 | A | | 1/1988 | Hayashida et al. | |
| 4,825,892 | A | | 5/1989 | Norman | |
| 4,938,243 | A | * | 7/1990 | Foster | 135/136 |
| 5,088,740 | A | * | 2/1992 | Peterson | 273/410 |
| 5,458,146 | A | * | 10/1995 | Gregg | 135/91 |
| 5,582,197 | A | * | 12/1996 | Dobberstein | 135/87 |
| 5,778,915 | A | | 7/1998 | Zheng | |
| 5,816,954 | A | | 10/1998 | Zheng | |
| 5,941,264 | A | * | 8/1999 | Gregg | 135/116 |
| 6,109,281 | A | * | 8/2000 | Lowenthal | 135/125 |
| 6,199,229 | B1 | * | 3/2001 | Wong | 5/417 |
| 6,257,263 | B1 | | 7/2001 | Brereton | |
| 6,360,760 | B1 | | 3/2002 | Louie et al. | |
| 6,363,955 | B1 | | 4/2002 | Louie | |
| 6,478,038 | B1 | * | 11/2002 | Le Gette et al. | 135/96 |
| 6,698,441 | B1 | * | 3/2004 | Zheng | 135/126 |
| 6,736,152 | B1 | * | 5/2004 | Zheng | 135/126 |
| 2004/0084075 | A1 | * | 5/2004 | Zheng | 135/143 |
| 2004/0211454 | A1 | * | 10/2004 | Zheng | 135/126 |

* cited by examiner

FOREIGN PATENT DOCUMENTS

| | | |
|---|---|---|
| GB | 2 340 516 A | 2/2000 |

*Primary Examiner*—Korie Chan
(74) *Attorney, Agent, or Firm*—Charmasson, Buchaca & Leach, LLP

(57) ABSTRACT

A collapsible and foldable canvas structure has only two structural panels, each formed by a piece of fabric material spread across and secured about its periphery to a resiliently flexible wire frame. One of the panels is laid flat on the ground or other supporting surface; the other rises vertically from a median section of the first and is held by straps or by sheets of fabric material not structured or framed by any wire but joined to the top of the vertical panel and to the outer edges of the flat one. A window cut on the center of the vertical panel provides access from one side to the other. The panels are substantially commensurate. They can be brought back together and twisted along with the remaining components of the structure into a compact package.

13 Claims, 2 Drawing Sheets

COLLAPSIBLE AND FOLDABLE CANVAS STRUCTURE

FIELD OF THE INVENTION

This invention relates to tentS and other light, temporary structures made of canvas stretched over foldable armatures.

BACKGROUND OF THE INVENTION

There is disclosed in the prior art, several types of collapsible and foldable tents and similar structures which use armatures made of wire loops across which sheets of canvas have been spread and attached about their periphery. U.S. Pat. No. 4,825,892 Norman, which patent is incorporated in this specification by this reference, discloses a typical embodiment of this type of structure.

In most self-erecting canvas structures of the prior art, the structural or supporting elements are constituted by roof, wall and floor panels, each including a resiliently wire frame. In some cases, one of the wire frame-supported elements is strengthened or replaced by external supporting or anchoring components such as posts, stakes, and other rigid implements which add weight and volume to the structure in its collapsed configuration.

The instant invention results from an attempt to simplify the construction of collapsible and foldable canvas structures by limiting the number of framed panels.

SUMMARY OF THE INVENTION

The principal and secondary objects of this invention are to provide a collapsible and foldable canvas structure that requires a limited number of structural panels made of a resilient wire frame upon which a piece of material has been stretched and peripherally secured, and to offer such a structure in a variety of configurations having multiple uses.

These and other valuable objects are achieved by using, as basic elements of a collapsible and foldable canvas structure, a preferably rectangular base panel having two opposite, longitudinal edges and a median longitudinal axis, and second panel held vertically and orthogonally above the longitudinal median axis of the base panel. Each of the panels comprises a piece of fabric material spread across and peripherally secured to a resilient wire frame. The frame may be constituted by a closed wire loop confined within a channel formed in the periphery of the sheet of fabric material. Alternately, the frame may be an open length of wire extending along all the edges of the piece of fabric material minus one. Both panels are commensurate and can be laid one on top of the other in a collapsed configuration then twisted into a compact package for transportation or storage. The second panel has a large window cut therethrough to allow passage from one side of the panel to the other. The second panel is held in its vertical position, in the absence of any other wire-framed panel, by two flexible and pliable tensile members such as one or more fabric web or straps or, preferably, by two sheets of fabric material, each of said members having a longitudinal edge attached to the top edge of the second panel and another opposite longitudinal edge attached to a longitudinal edge of the base panel.

DESCRIPTION OF THE PREFERRED EMBODIMENT OF THE INVENTION

Figure 1:
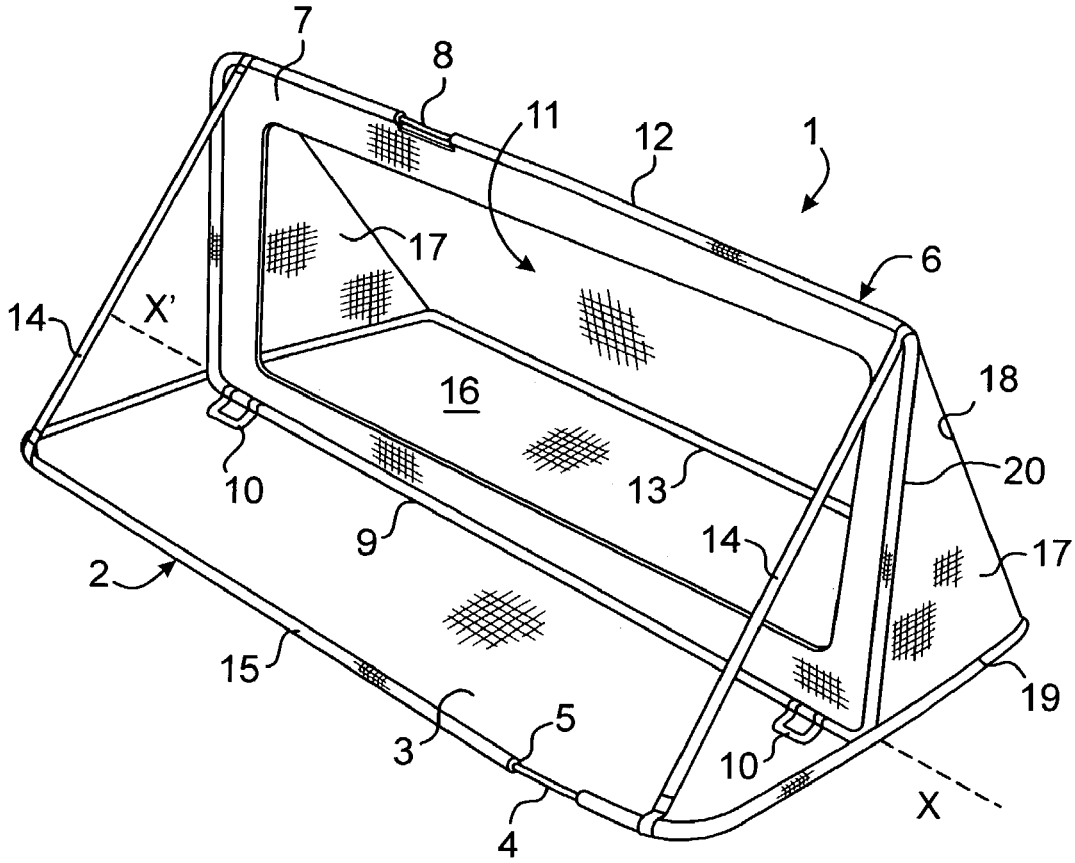
FIG. 1 is a perspective view of a first embodiment of the invention.

Referring now to the drawing, there is shown in FIG. 1, a first embodiment of a collapsible and foldable canvas structure 1 according to the invention. The structure comprises a base panel 2 made of a rectangular sheet of fabric material 3 stretched across, and peripherally secured to a resiliently flexible wire frame 4. According to a fabrication method well-known in the art, the wire frame 4 is captured in a tubular sleeve 5 formed along the edges of the piece of fabric material 3. A second panel 6 of substantially the same shape and dimension as the base panel 2 is positioned in a vertical position orthogonally to the first panel 2 and approximately above the median longitudinal axis X–X' of the first panel 2. The second panel 6 is similarly constructed from a piece of fabric material 7 spread across and peripherally attached to a second resiliently flexible wire frame 8. The lower edge 9 of the second panel is releasably attached to the base panel 2 by means of cooperating hooks-and-loop fabric fastener patches 10 or other equivalent attaching means such as straps, laces or pressure fasteners. A third panel 11 formed by a sheet of fabric material not structured by any peripheral wire armature extends from the top edge 12 of the second panel 6 to one of the longitudinal edges 13 of the base panel 2. A pair of straps are releasably attached at opposite ends of the top edge 12 of the second panel and to the other longitudinal edge 15 of the first panel 2. The back panel 11 and the straps 14 are dimensioned to place and keep the second panel 6 in a vertical orientation when the base panel 2 is laid on the ground or other horizontal surface. A large aperture or window 16 is cut through the second panel 6. Two triangular pieces 17 of fabric material are either, permanently secured along a first side to a latitudinal edge 18 of the third panel 11, along a second side to one half of a latitudinal edge 19 of the base panel 2, and along the third side 20 to a latitudinal side of the second panel 6, or secured wholly or partially only along one or two sides.

This particular structure can be used as a target or goal in the practice of soccer, hockey or other similar sports. Without the aperture through the second panel 11, it can be used as a projection screen or as a tent or other type of temporary shelter.

Figure 2:
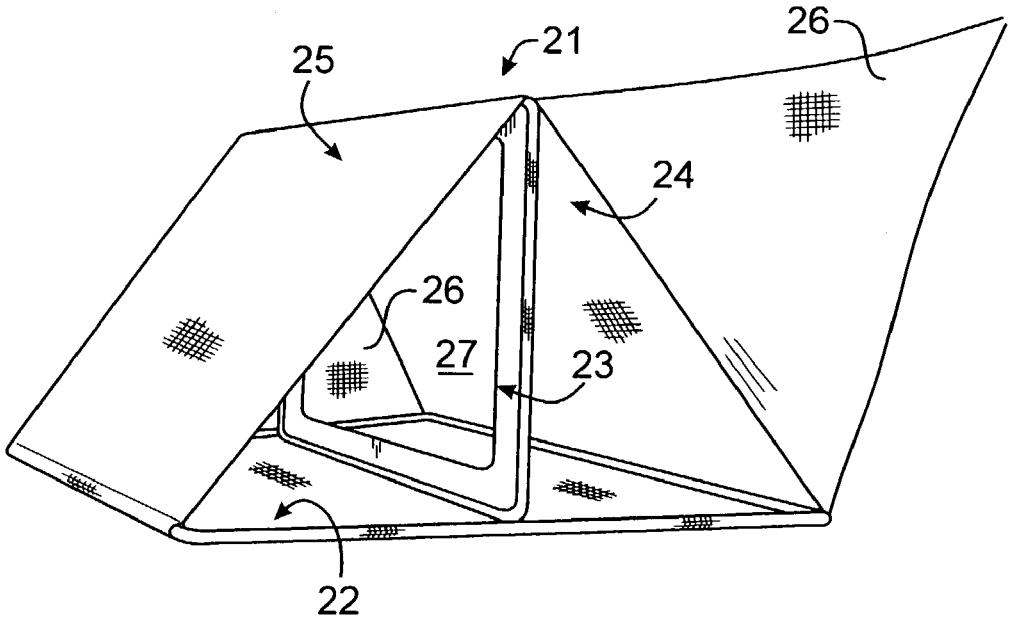
FIG. 2 is a perspective view of a second embodiment of the invention.
Figure 4:
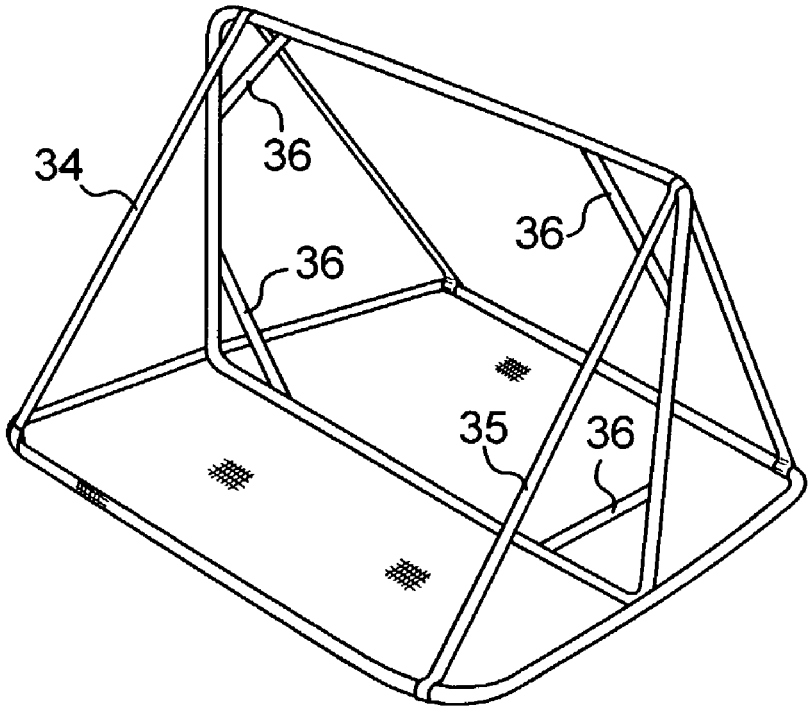
FIG. 4 is a perspective view of a fourth embodiment of the invention.

The second embodiment of the invention 21 illustrated in FIG. 2 includes a base panel 22, a vertical panel 23 and a third panel 24 that are essentially similar to those described in connection with the first embodiment of FIG. 1. A fourth panel 25 similar and symmetrical to the third panel 24 is used in lieu of the straps 14 of the first embodiment to hold the second panel 23 in its vertical orientation. Triangular end walls 26 unsecured to any frame, one of which is shown in an open position on the drawing, are made of fabric material and provide a releasable closure at either end of the structure. The window aperture 27 in the vertical panel 23 can be eliminated to provide an effective septum between two halves of the structure. At least one of the lateral panels 24,25 should be detachable along one of its longitudinal edges or have a width equal to or greater that the common width of the base and vertical panels in order to allow for easy collapsing and folding of the structure. The third and fourth panels 24, 25 are preferably made of a single sheet of fabric material permanently secured in its median section to the top edge 12 of the second panel, and at both ends to the longitudinal edges of the base panel. Alternately, two pairs of straps 34, 35 can be used in lieu of the third and fourth panels as illustrated in FIG. 4. The second panel is stabilized with four diagonal straps 36. It should be understood that the end walls 26 may be permanently secured along all their three sides to the other panels providing that an access to the inside the structure is practiced through one of the end walls 26 or one of the longitudinal panels 24, 25.

Figure 3:
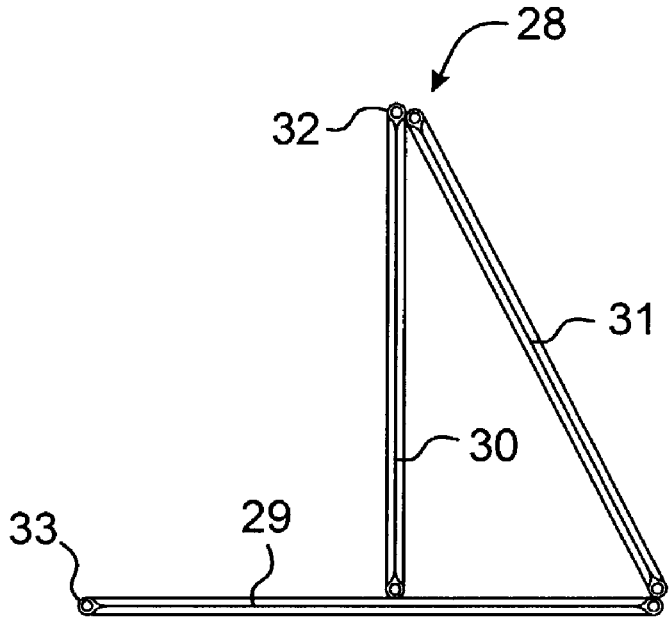
FIG. 3 is a cross-sectional view of a third embodiment of the invention.

In the third embodiment of the invention 28 illustrated in FIG. 3, three framed panels 29, 30, 31 are used without need of any strap or other panel between the top of the structure 32 and the unattached longitudinal edge 33 of the base panel 29.

While the preferred embodiments of the invention have been described, modifications can be made and other embodiments may be devised without departing from the spirit of the invention and the scope of the appended claims.

The invention claimed is:

1. A collapsible and foldable canvas structure which comprises:

a base having a longitudinal, median axis and including a first resiliently flexible wire frame and a first piece of fabric material spread across and peripherally attached to said first frame;

a flexible and pliable tensile member;

each of said base and tensile member having first and second opposite longitudinal edges parallel to said axis, the first longitudinal edge of one being attached to the first longitudinal edge of the other; and a second resiliently flexible, closed wire frame having a top edge attached to the second longitudinal edge of said tensile member and a bottom edge opposite said top edge resiliently attached to said base substantially along said axis; and a second piece of fabric material spread flatly across and peripherally attached along all sides to said second frame;

said tensile member and second frame being shaped and dimensioned to place said second frame in a substantially vertical plane when said base is laid upon a horizontal surface.

2. The structure of claim 1, wherein said tensile member comprises a third piece of fabric material.

3. The structure of claim 2, wherein said tensile member further comprises a third resiliently flexible wire frame, and wherein said third piece of material is spread across and attached to said third frame.

4. The structure of claim 1, wherein said second piece has an aperture therethrough.

5. The structure of claim 1 which further comprises a front panel including an additional piece of fabric material not structured by any frame;

said front panel having first and second opposite and longitudinal edges, one of said edges being attached to the second longitudinal edge of said base and the other to the top edge of said second frame.

6. The structure of claim 5 which further comprises triangular pieces of fabric material each being shaped and dimensioned for attachment to latitudinal edges of said front panel and second frame.

7. The structure of claim 1 wherein said tensile member comprises at least one strap dimensioned for attachment between said top edge and the second longitudinal edge of said base.

8. The structure of claim 1 wherein said tensile member comprises a pair of straps each dimensioned for attachment between and astride said top edge and the second longitudinal edge of said base.

9. A self-erecting and foldable structure which comprises:

first and second panels having substantially equal widths, each of said panels including a closed resiliently flexible wire frame and a piece of fabric material spread flatly across and attached along its entire periphery to said frame, each of said panels further including two opposite, parallel and substantially straight longitudinal edges and opposite latitudinal edges;

a third panel made of sheet of fabric material not structured by any peripheral armature, said third panel being secured along two longitudinal edges to a first of said longitudinal edges of each of said first and second panel;

means for securing a second of said longitudinal edges of said first panel to a median portion of the second panel; and means for holding said first and second panels substantially orthogonal to each other.

10. The structure of claim 9, wherein said first panel has a window cut therethrough.

11. The structure of claim 9, wherein said means for holding comprises a fourth panel attached at opposite lateral edges to the secured edges of said first and third panels and to the unsecured edge of said second panel.

12. The structure of claim 11, wherein said fourth panel comprises a piece of fabric material.

13. The structure of claim 12, wherein said first panel has a window cut therethrough.

* * * * *